US007115831B2

(12) United States Patent
Chyla et al.

(10) Patent No.: US 7,115,831 B2
(45) Date of Patent: Oct. 3, 2006

(54) VACUUM INTERRUPTER WITH A SWITCH CONTACT PIECE

(75) Inventors: Thomas Chyla, Berlin (DE); Jörg Hagen, Berlin (DE); Helmut Holler, Berlin (DE); Karl Mascher, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/505,023

(22) PCT Filed: Feb. 14, 2003

(86) PCT No.: PCT/DE03/00583

§ 371 (c)(1),
(2), (4) Date: Aug. 19, 2004

(87) PCT Pub. No.: WO03/071567

PCT Pub. Date: Aug. 28, 2003

(65) Prior Publication Data

US 2005/0092713 A1 May 5, 2005

(30) Foreign Application Priority Data

Feb. 20, 2002 (DE) ..... 102 07 892

(51) Int. Cl.
*H01H 33/66* (2006.01)

(52) U.S. Cl. ..... 218/124; 218/154

(58) Field of Classification Search ..... 218/118, 218/120, 123–126, 140, 153, 154, 78, 84, 218/92, 7, 10, 14

See application file for complete search history.

(56) References Cited

U.S. PATENT DOCUMENTS

| | | | | |
|---|---|---|---|---|
| 3,733,452 | A * | 5/1973 | Strippoli et al. | 218/66 |
| 4,168,414 | A * | 9/1979 | Kumbera et al. | 200/401 |
| 4,384,179 | A | 5/1983 | Milianowicz | |
| 4,489,226 | A * | 12/1984 | Holmgren et al. | 218/57 |
| 4,568,804 | A * | 2/1986 | Luehring | 218/138 |
| 4,577,073 | A * | 3/1986 | Talpo | 218/59 |
| 5,753,875 | A | 5/1998 | Benke et al. | |

FOREIGN PATENT DOCUMENTS

| | | |
|---|---|---|
| DE | 35 29 386 | 2/1987 |
| DE | 44 45 172 | 6/1996 |
| DE | 196 03 157 | 7/1997 |

OTHER PUBLICATIONS

WO 2004/097873 Stoving et al.*

* cited by examiner

*Primary Examiner*—Elvin Enad
*Assistant Examiner*—M. Fishman
(74) *Attorney, Agent, or Firm*—Morrison & Foerster LLP

(57) ABSTRACT

According to the invention, heat generated inside a vacuum interrupter (1) is to be extracted, essentially by means of the pins (7, 8) of the contact pieces (5, 6) and, in order to improve the transmission of heat, a first slide contact surface (18) of a slide contact arrangement is provided on a pin (7), whereby the first slide contact surface (18) is arranged on a first section of a pin (7) which comprises an enlarged circumference relative to the remaining sections of the pin (7).

9 Claims, 1 Drawing Sheet

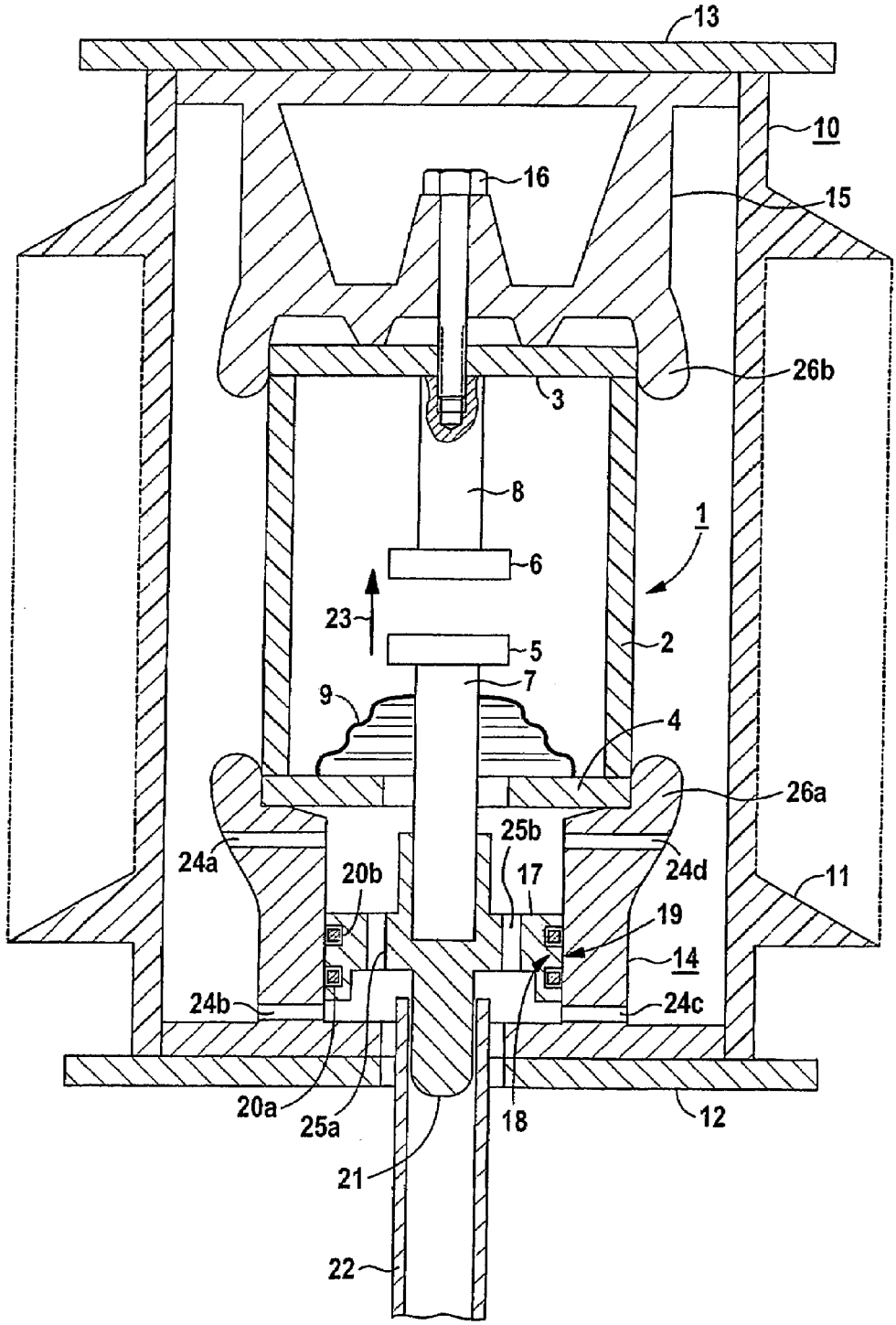
13
10
16
15
26b
3
8
1
6
23
5
2
7
9
4
26a
25b
24a
20b
17
24d
11
19
14
24b
24c
20a
25a
18
12
21
22

VACUUM INTERRUPTER WITH A SWITCH CONTACT PIECE

This application is a national stage of International Application No. PCT/DE03/00583 which was published on Feb. 14, 2003, and which claims the benefit of priority to German Application No. 102 07 892.0 filed Feb. 20, 2002.

TECHNICAL FIELD OF THE INVENTION

The invention relates to a vacuum interrupter having a switching contact piece.

BACKGROUND OF THE INVENTION

A vacuum interrupter arrangement is disclosed, for example, in DE 35 29 386 A1. The first sliding contact face here is arranged on a thicker, first section and is electrically conductively connected to a second sliding contact face.

A further arrangement is disclosed, for example, in the laid-open specification DE 196 03 157 A1. The vacuum interrupter described in the laid-open specification has a switching contact. The switching contact is essentially formed from two switching contact pieces, one of the switching contact piece being movable. The movable switching contact pieces has, at its end which faces away from the switching contact, a strut which is passed in a gas-tight manner through the wall of the vacuum interrupter by means of an elastic bellows. Directly adjoining the wall which is interrupted by the movable switching contact piece is a fixed contact to which the movable switching contact piece is electrically conductively connected. For this purpose, a self-sprung contact element made of beryllium bronze is provided there and this contact element is in the form of a helical spring and extends around the strut of the movable switching contact piece. By means of the self-sprung contact element, the switching contact piece is electrically conductively connected to the fixed contact.

Such self-sprung contact elements in the form of helical springs ensure that sufficient electrical contact is made. Owing to the excellent electrical and thermal insulation of the vacuum located in the interior of the vacuum interrupter, there is essentially only the strut, which is passed to the outside, of the movable switching contact piece for the purpose of dissipating the heat produced at the contact point. The known self-sprung contact elements in the form of helical springs are, in addition to the transmission of electrical power, only suitable to a certain extent for transmitting and passing on heat to other modules. In particular in the case of the arrangement known from the laid-open specification DE 196 03 157 A1, transmission of thermal energy to the surrounding environment is only possible to a limited degree owing to the direct arrangement of the self-sprung contact elements on the vacuum interrupter.

SUMMARY OF THE INVENTION

The invention relates to a vacuum interrupter having a switching contact piece which has, at its end which faces away from the switching contact of the vacuum interrupter, a strut which is connected to a first sliding contact face which forms, with a second sliding contact face, a sliding contact arrangement, in which the strut has a first section having a greater circumference than the remaining sections of the strut, and the first sliding contact face is arranged on the first section.

The present invention discloses dissipating the heat produced in the interior of the vacuum interrupter more effectively.

The invention is achieved, in one embodiment, by the first section having through-openings.

Owing to its increased circumference, the contact face provided of the sliding contact arrangement is increased in size. This makes it possible to increase the number of points which are electrically and thermally connected between the first sliding contact face and the second sliding contact face. As the number of these points increases, the electrical load on each individual point is reduced and the transmission of thermal energy is improved. The first section having an increased circumference may be connected, for example, in an integral manner with the remaining parts.

The through-openings also increase the surface area which is available for dissipating current heat. Furthermore, the openings provide a way for a cooling medium to pass through. Such a cooling medium may be, for example, a gas or a fluid.

Advantageously, in one aspect, the through-openings in the first section to run from the end which faces away from the vacuum interrupter to that end which faces the vacuum interrupter.

During a switching procedure, the second section is moved in the manner of a piston through the medium surrounding it. In the process, this medium also flows through the openings. In particular in the case of disconnection procedures at high currents, such as short-circuit currents, for example, which bring about a high thermal load, the first section makes it possible to improve the cooling of the switching contact piece and of the strut.

In another aspect, the first section to be formed by an intermediate piece other than the strut.

Using an intermediate piece which forms the first section it is possible to retain the design for the struts of vacuum interrupters which is known per se. Depending on the technical boundary conditions of the field of application of the corresponding vacuum interrupters, using various intermediate pieces means that the circumference of the first section can be selected to be variable. One and the same vacuum interrupter having the corresponding strut of the switching contact piece can thus be used in different switching devices by using various intermediate pieces. The intermediate piece itself may likewise buffer-store and irradiate heat.

In one aspect, there is a drive apparatus to be coupled to the intermediate piece.

If the switching contact piece is coupled to a drive in order to move the switching contact piece, a corresponding coupling device is provided. If this coupling device is formed by the intermediate piece, this results in a very simple solution in design terms.

A further, advantageous embodiment may provide for the second sliding contact face to be arranged on a hollow body, in particular in the form of an armature.

Arranging the second sliding contact face on a hollow body makes it possible, in particular, for thermal energy to be transferred effectively from the first sliding contact face to the second sliding contact face. In the case of a very compact external form, the hollow body provides a large area of overlap between the two sliding contact faces. In comparison with individual, for example planar sections, such a hollow body also makes it possible to achieve a favorable dielectric design.

In still another aspect, the hollow body is made to at least partially retain the vacuum interrupter.

In addition to forming the second contact face of the sliding contact arrangement, it is advantageous if the hollow body at least partially retains the vacuum interrupter. By combining the means for making the electrical and thermal contact and for retaining, the number of necessary modules is reduced. Furthermore, a hollow body is suitable, owing to its large surface area, for emitting, in turn, thermal energy transmitted to it to its surrounding environment.

In order to have a positive effect on the emission of thermal energy from the hollow body, provision may also be made for the hollow body to have openings through which a medium may flow.

Such a medium may be, for example, a gas which is arranged around the vacuum interrupter and the hollow body. As other media, it is also possible to use fluid media, for example insulating oils. The openings in the hollow body make it possible for media to flow through the interior of the hollow body, thus providing for effective heat exchange. In order to have a favorable effect on the emission of heat, the surfaces of the heat-emitting modules can be provided with a coating. Such coatings are, for example, paint coatings which improve emission and/or increase the surface area.

Furthermore, in another aspect, at least one elastic contact element may be connected to the first sliding contact face.

If an elastic contact element is connected to the first sliding contact face, the number of points with which contact has been made between the first sliding contact face and the second sliding contact face can be increased in a simple manner. This improves both the electrical and the thermal contact between the two sliding contact faces. The contact elements are in the form of, for example, strips which are bent in the form of a ring and are made of an electrically conductive material. The strips have elastically sprung fingers which are, for example, stamped and impressed out of the strips.

One advantageous embodiment may also provide for the elastic contact element to be mounted in a groove which runs azimuthally around the longitudinal axis of the strut.

The elastic contact element may be positioned in a simple manner using a groove which runs in the form of a ring along the longitudinal axis of the strut. In particular in the case of an embodiment of the elastic contact element in the form of a ring, the contact element may be mounted such that it can move within the groove, but may be positioned such that it is fixed with respect to the first section.

BRIEF DESCRIPTION OF THE DRAWINGS

An exemplary embodiment of the invention is shown below with reference to a drawing and described in more detail below.

In the drawing:

FIG. 1 shows a vacuum interrupter having a switching contact piece and a sliding contact arrangement.

DETAILED DESCRIPTION OF THE INVENTION

FIG. 1 shows a vacuum interrupter 1. The vacuum interrupter 1 is part of an interrupter unit of a switching pole of an electrical switch. The vacuum interrupter 1 has an insulating housing 2 and a first cover plate 3 and a second cover plate 4. Arranged in the interior of the vacuum interrupter 1 is a first contact piece 5 and a second contact piece 6. The first contact piece 5 and the second contact piece 6 form a switching contact. At the end of the first contact piece 5 which faces away from the switching contact, a first strut 7 is passed through the second cover plate 4 such that it can move. A second strut 8 bears the second contact piece 6 and positions it rigidly on the first cover plate 3. In order to pass the first strut 7 in a gas-tight manner through the wall of the vacuum interrupter 1, a bellows 9 is arranged between the first strut 7 and the second cover plate 4.

The vacuum interrupter 1 is arranged within an insulating housing 10. The insulating housing 10 is essentially cylindrical and has a ribbed section 11 on its outer surface. The end faces of the insulating housing 10 are sealed by a first closing armature 12 and a second closing armature 13. The first and the second closing armature 12, 13 are manufactured from an electrically conductive material and also serve the purpose of connecting the electrical conductors of a current path to be connected. The vacuum interrupter 1 is arranged in the interior of the insulating housing 10. As an alternative to this, provision may be made for the vacuum interrupter 1 to be arranged in an electrically conductive housing. The vacuum interrupter 1 must then be mounted such that it is insulated with respect to the conductive housing. For the purpose of retaining the vacuum interrupter 1 and for making electrical contact with the contact pieces 5, 6, a first retaining armature 14 is connected to the first closing armature 12, and a second retaining armature 15 is connected to the second closing armature 13. The vacuum interrupter 1 is retained between the two retaining armatures 14, 15. The second retaining armature 15 has a hole through which a screw 16 is passed. The screw 16 presses the first cover plate 3 of the vacuum interrupter 1 against the second retaining armature 15, and makes contact between the second contact piece 6 and the second closing armature 13 via the second strut 8 and the first cover plate 3. The first retaining armature 14 positions the vacuum interrupter 1 in the axial and radial direction. Both the first retaining armature 14 and the second retaining armature 15 have, at their ends which face the vacuum interrupter 1, beads 26*a, b* which provide dielectric shielding. The interior of the insulating housing 10 is filled with an insulating gas.

The first retaining armature 14 is in the form of a hollow body which has a cylindrical recess in its interior. The first strut 7 protrudes into this cylindrical recess. At the end of the first strut 7 which faces away from the first contact piece 5, the first strut 7 has an intermediate piece 17. This intermediate piece 17 forms a first section having a greater circumference than the remaining sections of the strut 7. The first section has a first sliding contact face 18. The cylindrical inner wall of the first retaining armature 14 is in the form of a second sliding contact face 19. The second sliding contact face 19 is mounted such that it is fixed with respect to the insulating housing 10. The first sliding contact face 18 and the second sliding contact face 19 form a sliding contact arrangement. For the purpose of improving the electrical and thermal contact between the first sliding contact face 18 and the second sliding contact face 19, the first section of the intermediate piece 17 has a first annular groove 20*a* and a second annular groove 20*b*. An annular, resilient contact element is inserted in each of the annular grooves 20*a*, 20*b*. The elastic contact elements improve the contact between the first sliding contact face 18 and the second sliding contact face 19. The number of contact elements may be selected. Depending on the current load, one, two or more contact elements may be arranged on the intermediate piece 17. As an alternative to this, provision may be made for the elastic contact elements to be mounted such that they are fixed to the second contact face 19. In the exemplary embodiment illustrated in FIG. 1, the first section is formed by a separate intermediate piece 17. Provision may be made for this intermediate piece 17 to be formed integrally as part of the first strut 7.

At its end which faces away from the vacuum interrupter 1, the intermediate piece 17 has a pin 21. A drive rod 22 is connected to the pin 21. This drive rod 22 transfers the movement of a drive (not shown in the FIGURE) to the intermediate piece 17 and thus to the first contact piece 5 via the first strut 7. The arrow provided with the reference numeral 23 illustrates the movement of the first contact piece 5 when the switching contact is being closed.

The first retaining armature 14 has two or more openings 24*a, b, c, d*. The insulating gas arranged in the interior of the insulating housing 10 flows through the openings 24*a, b, c, d* in the first retaining armature 14. In order to have a favorable effect on the flow through the recess in the retaining armature 14, the intermediate piece 17 has openings 25*a*, 25*b*. This makes it possible to produce a flow driven by convection in the interior of the first retaining armature 14. The heat transmitted via the first strut 7 into the interior of the first retaining armature 14 can thus be dissipated in a simple manner to the outside. In addition, the outer surface of the first retaining armature 14 emits further heat radiation. Some of the heat is transmitted directly to the first retaining armature 14 from the first contact piece 5 via the first strut 7, the intermediate piece 17 and the sliding contact arrangement and is emitted to its surrounding environment from the first retaining armature 14. The heat produced is largely caused by $I^2R$ losses or by arcs formed between the first contact piece 5 and the second contact piece 6 during switching procedures.

What is claimed is:

1. A vacuum interrupter comprising:

a stationary contact and a moveable contact, the stationary contact and the moveable contact making a switching contact piece; and a strut connected to the moveable contact, wherein an end of the strut facing away from the switch contact piece includes an intermediate piece, the intermediate piece having a first sliding contact face which forms, with a second sliding contact face, an electrically conductive sliding contact arrangement, the intermediate piece having a greater circumference than remaining sections of the strut for improving electrical and thermal contact between the first sliding contact face and the second sliding contact face, and the intermediate piece has through-openings.

2. The vacuum interrupter as claimed in claim 1, wherein the through-openings in the strut run from the end facing away from the vacuum interrupter to an end facing the vacuum interrupter.

3. The vacuum interrupter as claimed in claim 1, wherein the intermediate piece is inserted into the strut.

4. The vacuum interrupter as claimed in claim 3, wherein a drive apparatus may be coupled to the intermediate piece.

5. The vacuum interrupter as claimed in claim 1, wherein the second sliding contact face is arranged on a hollow body in the form of an armature.

6. The vacuum interrupter as claimed in claim 5, wherein the hollow body at least partially retains the vacuum interrupter.

7. The vacuum interrupter as claimed in claim 5, wherein the hollow body has openings through which a medium may flow.

8. The vacuum interrupter as claimed in claim 1, wherein at least one elastic contact element is connected to the first sliding contact face.

9. The vacuum interrupter as claimed in claim 8, wherein the elastic contact element is mounted in a groove which runs azimuthally around the longitudinal axis of the strut.

* * * * *